US005710541A

United States Patent [19]

Stanley et al.

[11] Patent Number: 5,710,541

[45] Date of Patent: Jan. 20, 1998

[54] SMOKE/FIRE DETECTOR

[75] Inventors: Lawrence G. Stanley, Templeton; Wayne A. Nelson, Maynard, both of Mass.

[73] Assignee: Simplex Time Recorder Co., Gardner, Mass.

[21] Appl. No.: 511,019

[22] Filed: Aug. 3, 1995

[51] Int. Cl.[6] ..... G08B 17/10

[52] U.S. Cl. ..... 340/628; 340/693; 361/822; 439/404

[58] Field of Search ..... 347/697, 629, 347/630, 632, 628, 687; 361/822, 823, 824; 439/839, 856, 857, 858, 861, 862, 778, 404, 437, 438, 439

[56] References Cited

U.S. PATENT DOCUMENTS

| | | | |
|---|---|---|---|
| 4,140,761 | 2/1979 | Socher | 439/682 |
| 4,230,383 | 10/1980 | Burnstein et al. | 439/620 |
| 4,720,276 | 1/1988 | Takahashi | 439/861 |
| 4,887,073 | 12/1989 | Nakao et al. | 340/693 |

*Primary Examiner*—Jeffery Hofsass
*Assistant Examiner*—Edward Lefkowitz
*Attorney, Agent, or Firm*—Fish & Richardson, P.C.

[57] ABSTRACT

A smoke/fire detector assembly having a base section and a removable sensor section. The base section includes a plurality of electrical contacts and the sensor section includes a corresponding plurality of electrical contacts. Each one of the sensor section electrical contacts includes a member having a first end, extending from the sensor section, and a second end electrically connected to electrical components within the sensor section. Each one of the base section electrical contacts has: a first section having a surface adapted for mounting to a surface of the base section; a second section, having an edge common with the first section and a surface extending perpendicular to the surface of the first section; and, a pair of finger-like members, extending from a second edge of the second section. The second edge of the second section is perpendicular to the common edge. The finger-like members are laterally spaced along, and cantilevered from, the second edge of the second section. The finger-like members extend along a common direction. Distal ends of the finger-like members are spaced from each other laterally in a direction perpendicular to the common direction to receive, and contact, opposing surfaces of the first end of the sensor electrical contact. The first section, second section, and pair of finger-like members are a stamped, single piece thereby reducing the number of pieces required in fabricating the base section of the smoke/fire detector assembly.

14 Claims, 8 Drawing Sheets

SMOKE/FIRE DETECTOR

BACKGROUND OF THE INVENTION

This invention relates generally to smoke/fire detectors and more particularly to smoke/fire detectors having a base section and removable sensor section.

As is known in the art, one type of smoke/fire detector is made up of a base section and a removable sensor section. The base section is adapted for mounting to a ceiling, wall or other building structural member and includes electrical terminals for enabling electrical connection to the building wiring to provide electrical power to the detector and smoke/fire detection signals to a remotely located station, for example.

The sensor section includes the smoke/fire detection element, such as an ionization, photo-optical or heat sensor. The sensor section is removable from the base in order to replace one type of sensor with another type, or to replace the sensor when it becomes defective. Thus, each sensor section/base section pair must be constructed to provide for both mechanical and electrical removable/attachable interconnection. Further, in some countries, each electrical interconnection is required to use a bifurcated contact; that is, when one electrical contact is to engage, or mate with another electrical contact, one of the contacts must make physical contact with at least two points of the other, mating electrical contact. Thus, each base section electrical contact, for example, must make physical contact with two points on each corresponding sensor section electrical contact. While the two contact points may be on one surface of the mating contact, improved mechanical stability results when the two contact points are on opposing surfaces of the mating contact.

In one base section/detector section arrangement, the base section includes a pair of separate electrical contacts for engagement with points on opposite surfaces of a corresponding sensor section electrical contact. Each one of the pair of electrical contacts of the base section is a stamped, single piece having a relatively large mounting portion which terminates into an elongated, cantilevered finger-like contact. The mounting portions of the pair of contacts are encapsulated into the plastic, generally disk shaped, base section and are electrically connected to a common screw fixture also encapsulated into the base section. A screw, threaded into the screw fixture, provides an electrical terminal for securing an electrical wire which provides power to, or receives sensor signals from, the sensor section. The sensor section electrical contact is adapted to mate, and contact, with the pair of base electrical contacts and has opposing surfaces which are disposed in planes parallel to the base. The distal ends of the finger-like contacts of the pair of base electrical contacts extend in opposing, vertically spaced directions parallel to the surface of the base section and are configured to engage the opposing surfaces of the corresponding sensor section electrical contact when the sensor electrical contact is inserted into the space between the corresponding pair of finger-like base section electrical contacts. The engagement provides electrical connection between the base section pair of contacts and the sensor section contact, and also provides a mechanical inter-lock between the base section and the sensor section.

SUMMARY OF THE INVENTION

In accordance with the present invention, a smoke/fire detector assembly is provided having a base section and a removable/attachable sensor section. The base section includes a plurality of electrical contacts and the sensor section includes a corresponding plurality of electrical contacts. Each one of the sensor section electrical contacts extends longitudinally from the sensor section and each one of the base section electrical contacts has a pair of finger-like members positioned to electrically contact points longitudinally spaced along opposite surfaces of the sensor electrical contacts. The sensor section electrical contacts and the base section electrical contacts are each a stamped, single piece thereby reducing the number of pieces required in fabricating the smoke/fire detector assembly. Further, with such an arrangement, the attachment of the base and sensor sections may be performed by robotics (i.e., automation) type assembly equipment, further reducing the cost of the detector. Still further, using longitudinally extending electrical contacts for the sensor section enables such section to be robotically inserted into a sensor section test fixture. The tested sensor section may be robotically removed from the test fixture, and then, if successfully tested, robotically attached to a corresponding base section.

In accordance with another feature of the invention, an additional base section electrical contact is provided to engage, together with one of the aforementioned base section electrical contacts, a common one of the sensor section electrical contacts. The additional base section electrical contact is bifurcated to make contact with two points on the same surface of the sensor section electrical contact, the opposite surface of such sensor section electrical contact being contacted the other, aforementioned, one of the base section electrical contacts.

BRIEF DESCRIPTION OF THE DRAWING

FIG. 3 being a side elevation view; FIG. 4 being a top view; FIG. 5 being a front elevation view; and, FIG. 6 being a perspective view;

FIG. 9 being a side elevation view; FIG. 10 being a top view; FIG. 11 being a front elevation view; and, FIG. 12 being a perspective view;

DESCRIPTION OF THE PREFERRED EMBODIMENTS

Figure 1:
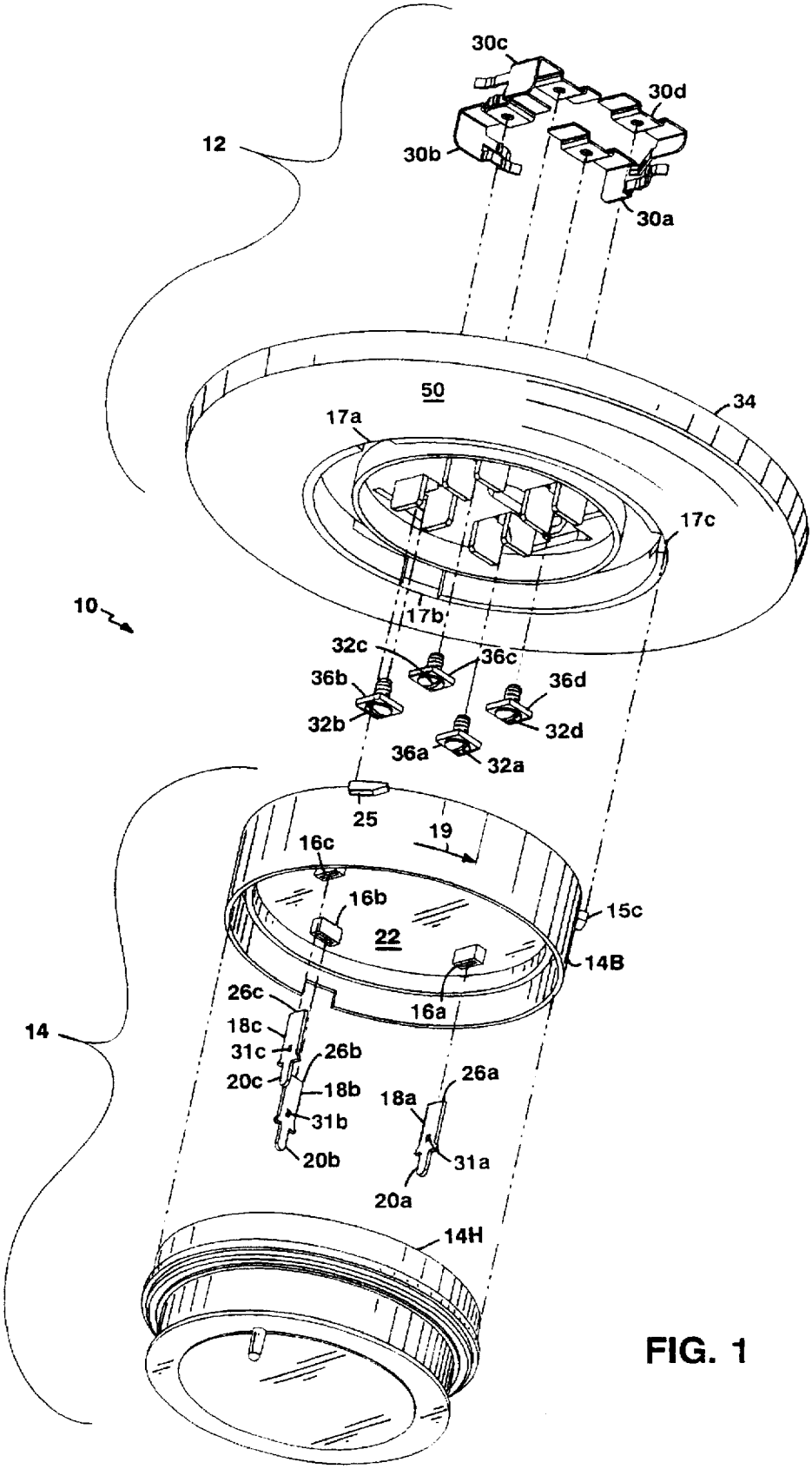
FIGS. 1 and 2 are perspective, exploded views of a smoke/fire detector according to the invention, FIG. 1 showing the detector from one perspective and FIG. 2 showing the detector from an opposite perspective.
Figure 2:
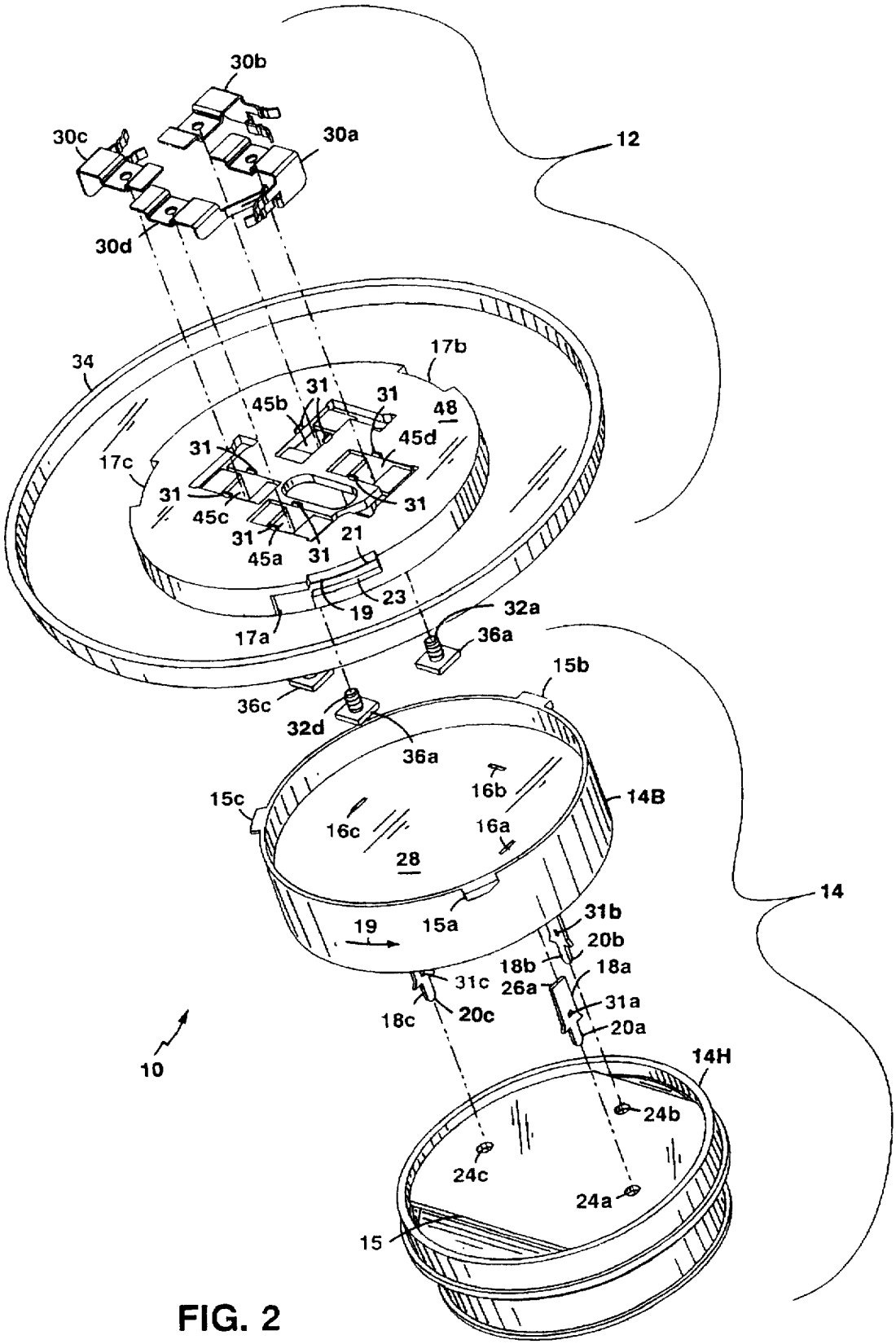
Figure 6:
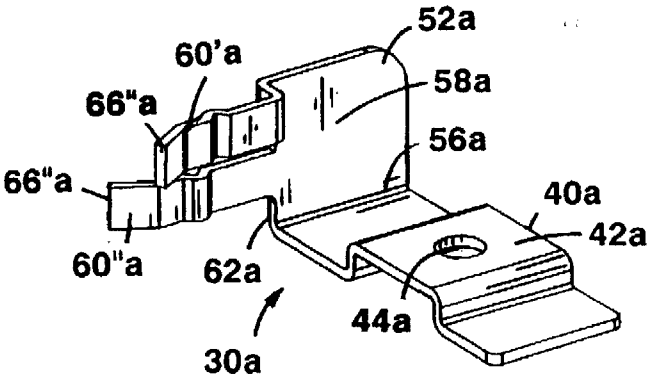
FIGS. 3, 4, 5 and 6 are views of an exemplary one of a plurality of electrical contacts included in a base section of the detector of FIGS. 1 and 2.
Figure 3:
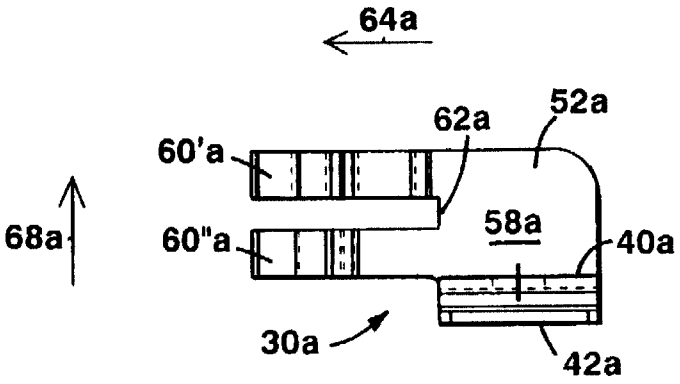
Figure 4:
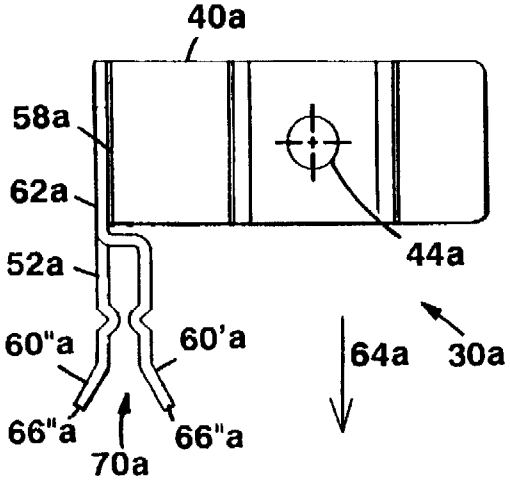
Figure 5:
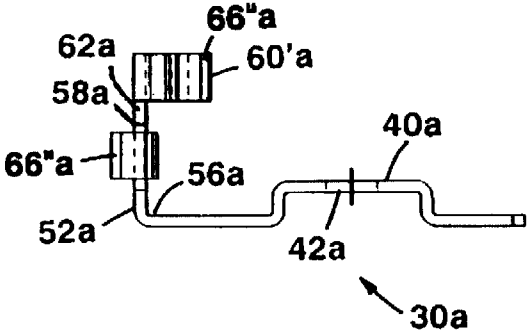

Referring now to FIGS. 1 and 2, a smoke/fire detector assembly 10 is shown. The assembly 10 includes a base section 12 and a removable/attachable sensor section 14.

The sensor section 14 includes a sensor head 14H and a removable/attachable sensor base 14B, both of dielectric material, here plastic. The sensor head 14H is of conventional design to encloses a smoke/fire detection element, not shown, such as an ionization, photo-optical or heat sensor. The smoke/fire detection element, not shown, and other electronic components, not shown, are electrically interconnected and mounted, in a conventional manner, by a printed circuit board 15 (FIG. 2). The printed circuit board 15, with its mounted smoke/fire detection element, not shown, and other electrical components, not shown, is mounted to the sensor head 14H in a conventional manner. The sensor head 14H is attachable/removable from the sensor base 14B in any conventional manner in order enable replacement of one type of smoke/fire detection element with another type, or to enable replacement of the sensor head 14H when it becomes defective.

The sensor base 14B is removable from, and re-attachable to, the base section 12. Here, the sensor base 14B has three spade shaped male electrical contacts 18*a*, 18*b*, 18*c*, respectively, as indicated. The male electrical contacts 18*a*, 18*b*, 18*c* are a stamped, single piece of electrically conductive material, here brass. More particularly, the three spade shaped male electrical contacts 18*a*, 18*b*, 18*c* are inserted through slots 16*a*, 16*b*, 16*c*, respectively, as indicated. Ends 20*a*, 20*b*, 20*c* of the electrical contacts 18*a*, 18*b*, 18*c*, respectively, protrude from surface 22 (FIG. 1) of sensor base 14B, pass through holes 24*a*, 24*b*, 24*c* (FIG. 2) respectively, formed in the printed circuit board 15, and plug into female electrical receptacles, not shown, mounted to the printed circuit board 15 for electrical connection to the smoke/fire detection element, not shown. The other ends 26*a*, 26*b*, 26*c* of electrical contacts 18*a*, 18*b*, 18*c*, respectively, protrude from surface 28 (FIG. 2) and are adapted to plug into base section 12 female electrical contacts 30*a*, 30*b*, 30*c*, respectively, in a manner to be described below. The mid-portion of electrical contacts 18*a*, 18*b*, 18*c*, are provided with detents 31*a*, 31*b*, 31*c*, respectively, which project outwardly from the surfaces of the electrical contacts 18*a*, 18*b*, 18*c*, as shown more clearly in FIG. 14*a* for detect 31*c*. These detents 31*a*, 31*b*, 31*c* are inserted into slots 35 formed in the sensor base 14B. Thus, each one of the electrical contacts 18*a*, 18*b*, 18*c* is disposed in the sensor base 14B of the sensor section 14 and projects longitudinally from such sensor section 14, here vertically from the sensor section 14, as shown.

Base section 12 includes: a dielectric, here plastic, mounting plate 34 adapted for mounting, in a conventional manner, to a ceiling, wall or other building structural member, not shown; the plurality of electrical contacts 30*a*, 30*b*, 30*c* which correspond, and electrically interconnect with, electrical contacts 18*a*, 18*b*, 18*c*, respectively; an additional electrical contact 30*d*; and screws 32*a*, 32*b*, 32*c*, 32*d*, respectively, and washers 36*a*, 36*b*, 36*c*, 36*d*, respectively, as shown, for affixing to electrical wires, not shown. Thus, screws 32*a*, 32*b*, 32*c* provide electrical terminal for the assembly 10. The electrical contacts 30*a*, 30*b*, 30*c*, 30*d* snap onto the bottom of conductors the electrical contacts 30*a*, 30*b*, 30*c*, 30*d*, respectively, to the bottom surface 48 (FIG. 2) of the base 12 by retaining snaps 31 which engage opposite surfaces of each one of the contacts 30*a*, 30*b*, 30*c*, 30*d*, as indicated in FIG. 2.

The base section 12 electrical contacts 30*a*, 30*b*, 30*c* which correspond, and electrically connect, to sensor section 14 electrical contacts 18*a*, 18*b*, 18*c* (FIGS. 1 and 2), are identical in construction. Here, each of the electrical contacts 30*a*, 30*b*, 30*c* is a stamped, single piece of electrically conductive material, here brass. An exemplary one thereof, here electrical contact 30*a*, is shown in detail in FIGS. 3, 4, 5 and 6. Thus, each one of the electrical contacts 30*a*, 30*b*, 30*c*, has a first section 40*a*, 40*b*, 40*c*, respectively, with a surface 42*a*, 42*b*, 42*c* adapted for mounting to the mounting plate 34. More particularly, the first sections 40*a*, 40*b*, 40*c*, respectively, snap onto the mounting plate 34 by snaps 31(FIG. 2) which snap onto opposing surface portions of the electrical contacts. More particularly, the surfaces 42*a*, 42*b*, 42*c* contact ledges of recessed pockets 45*a*, 45*b*, 45*c* (FIG. 2) formed, along with the snaps 31, into mounting plate 34. Further, the first sections 40*a*, 40*b*, 40*c*, each has a threaded hole 44*a*, 44*b*, 44*c*, respectively, to receive screws 32*a*, 32*b*, 32*c*. As noted above, the screws 32*a*, 32*b*, 32*c* provide an electrical terminal for connecting to the building wiring, not shown, to provide electrical power to the detector assembly 10 and smoke/fire detection signals from the detector element, not shown, to a remotely located monitoring station, not shown.

Figure 7:
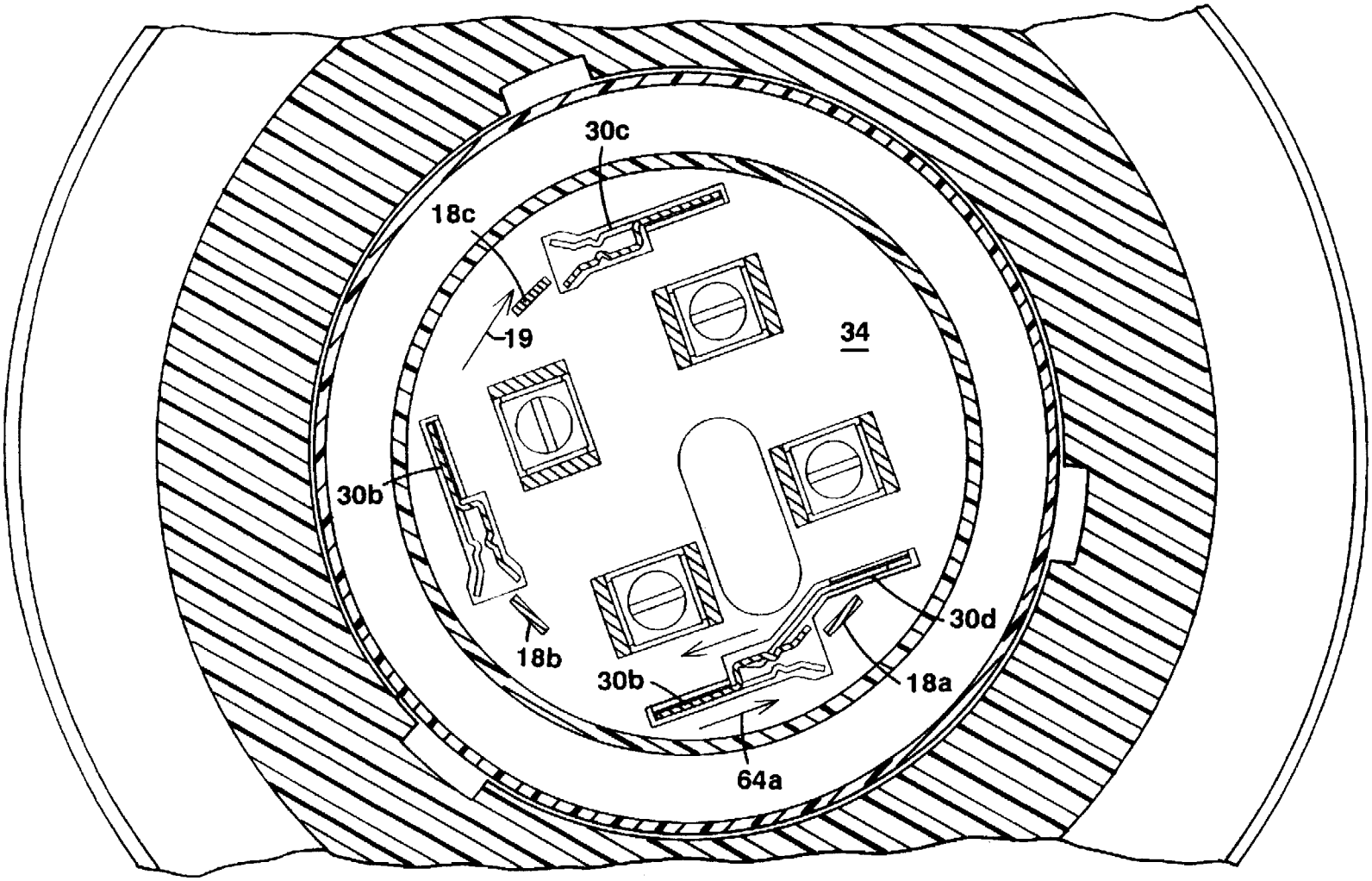
FIG. 7 is a plan view showing the relationship between electrical contacts of a sensor section of the detector of FIGS. 1 and 2 and the electrical contacts of the base section prior to such contacts becoming electrically connected.
Figure 8:
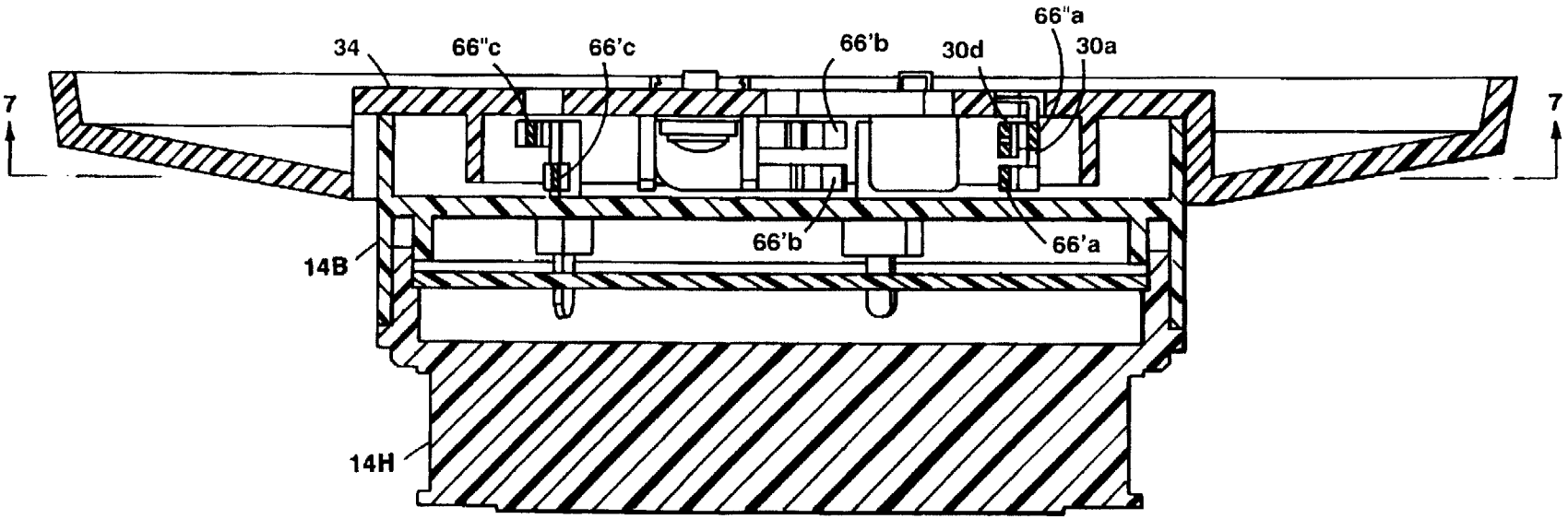
FIG. 8 is a elevation view showing the relationship between electrical contacts of the sensor section of the detector of FIGS. 1 and 2 and the electrical contacts of the base section prior to such contacts becoming electrically connected.
Figure 12:
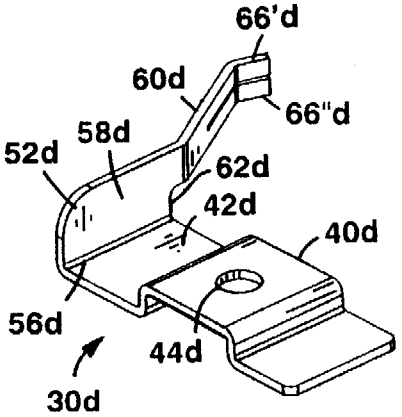
FIGS. 9, 10, 11, and 12 are views of an additional electrical contact included in a base section of the detector of FIGS. 1 and 2.
Figure 9:
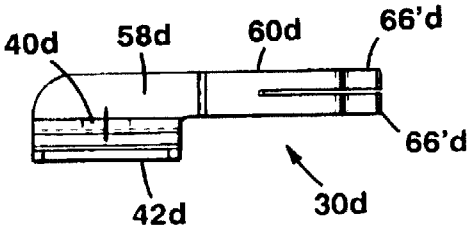
Figure 10:
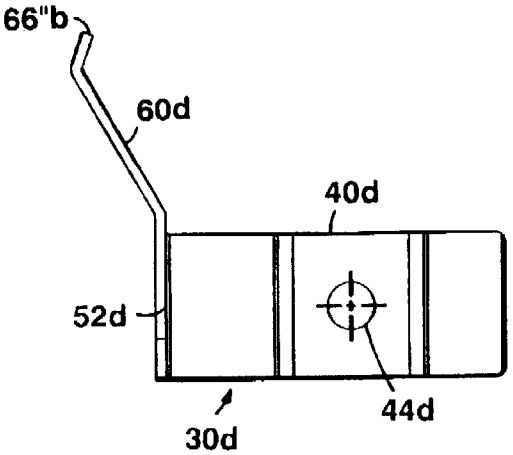
Figure 11:
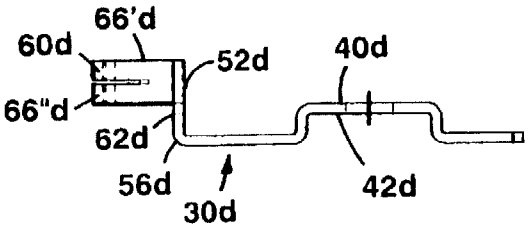

Each one of the base section 12 electrical contacts 30*a*, 30*b*, 30*c* also has a second section 52*a*, 52*b*, 52*c*, respectively. The first sections 40*a*, 40*b*, 40*c* and the second section 52*a*, 52*b*, 52*c* have a common edge 56*a*, 56*b*, 56*c*, respectively, as shown. Each of the electrical contacts 30*a*, 30*b*, 30*c* has a surface 58*a*, 58*b*, 58*c*, respectively, extending perpendicular to surface 42*a*, 42*b*, 42*c*, respectively, as shown, and a pair of finger-like members, 60'*a*, 60"*a*; 60'*b*, 60"*b*; 60'*c*, 60"*c*, respectively, extending from a second edge 62*a*, 62*b*, 62*c*, respectively, of the second section 52*a*, 52*b*, 52*c*, respectively, as shown. The second edge 62*a*, 62*b*, 62*c*, of the second section 52*a*, 52*b*, 52*c*, respectively, is perpendicular to the common edge 56*a*, 56*b*, 56*c*, of the first and second sections 40*a*, 52*a*, 40*b*, 52*b*, 40*c*, 52*c*, respectively. The finger-like members 60'*a*, 60"*a*; 60'*b*, 60"*b*, 60'*c*, 60"*c* are laterally spaced along, and cantilevered from, the second edge 62*a*, 62*b*, 62*c*, of the second section 52*a*, 52*b*, 52*c*, respectively. The finger-like members 60'*a*, 60"*a*, 60'*b*, 60"*b*, 60'*c*, 60"*c* extend along a common direction 64*a*, 64*b*, and 64*c*, respectively, as shown. Distal ends 66'*a*, 66"; 66'*b*, 66"*b*; 66'*c*, 66"*c* of the finger-like members 60'*a*, 60"*a*; 60'*b*, 60"*b*; 60'*c*, 60"*c*, respectively, are spaced from each other laterally in a direction 68*a*, 68*b*, 68*c*, respectively, as shown, perpendicular to the common direction 64*a*, 64*b*, 64*c*, respectively, as shown, to receive, in spaces 70*a*, 70*b*, 70*c*, and contact opposing surfaces of the first end 26*a*, 26*b*, 26*c*, of electrical contact 18*a*, 18*b*, 18*c*, respectively, as shown in FIGS. 7 and 8. Thus, each electrical interconnection is made by a bifurcated contact. That is, each base section electrical contact 30*a*, 30*b*, 30*c* makes physical contact with two points on opposing surfaces of the mating sensor section 14 electrical contact 18*a*, 18*b*, 18*c*, respectively, improving mechanical stability compared with an arrangement making contact with only two points on the same surface of a mating electrical contact.

The additional base section 12 electrical contact 30*d*, shown in detail in FIGS. 9, 10, 11 and 12, is provided to engage, together with one of plurality of base section 12 electrical contacts, here sensor section 12 electrical contact 20*a*, a common one of the sensor section 14 electrical contacts, here sensor section 14 electrical contact 18*a*, as shown. Thus, sensor section 14 electrical contact 18*a* is contacted by two base section electrical contacts, here electrical contact 30*a* and electrical contact 30*d*.

The additional electrical contact 30*d* is a stamped, single piece of electrically conductive material, here brass, and includes a first section 40*d* with a surface 42*d* adapted for mounting to the mounting plate 34 (FIGS. 1 and 2). More particularly, the first section 40*d* has a threaded hole 44*d* to receive, and thereby become secured to the base section 12, screws 32*d* (FIGS. 1 and 2). More particularly, the surface 42*d* contacts ledge of recessed pocket 45*d* (FIG. 2) formed in surface 48 mounting plate 34 and are affixed in place with screw 32*d* and washers 36*d* from the opposite surface 50 (FIG. 1) of the mounting plate 34. The screw 32*d* is are also used to provide an electrical terminal for connecting to the building wiring, not shown.

Electrical contact 30*d* also has a second section 52*d*. The first section 40*d* and the second section 52*d* have a common edge 56*d*, as shown. The electrical contact 30*d* has a surface 58*d* extending perpendicular to surface 42*d*, as shown, and a finger-like member 60*d* extending from a second edge 62*d* of the second section 52*d*, as shown. The second edge 62*d* of the second section 52*d* is perpendicular to the common edge 56*d* of the first and second sections 40*d*, 52*d*. The finger-like member 60*d* is cantilevered from the second edge 62*d* of the second section 52*d*. The finger-like member 60*d* extends is a direction opposite to direction 64*a* of contact 30*a*. The distal end of the finger-like member 60*d* of the additional base section 12 electrical contact 30*d* is bifurcated to provide two distal ends 66'*d*, 66"*d*, to make contact with two points on the same surface of the sensor section 14 electrical contact 18*a*, the opposite surface of such sensor section 14 electrical contact 18*a* being contacted by the pair of finger-like members 60'*a*, 60"*a* of base section 12 electrical contact 30*a*.

Figure 13:
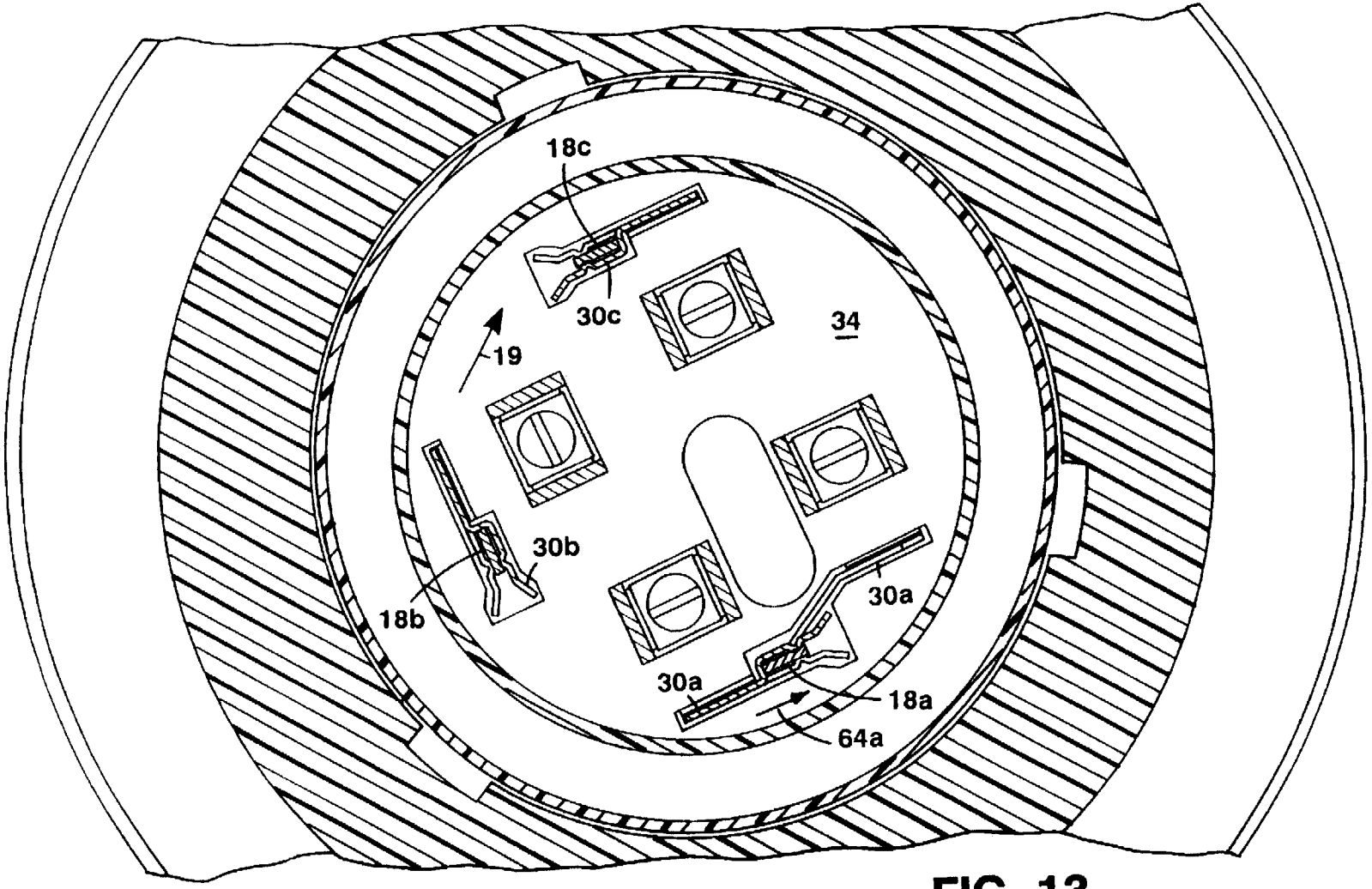
FIG. 13 is a plan view showing the relationship between electrical contacts of a sensor section of the detector of FIGS. 1 and 2 and the electrical contacts of the base section after such contacts become electrically connected.
Figures 14, 14A:
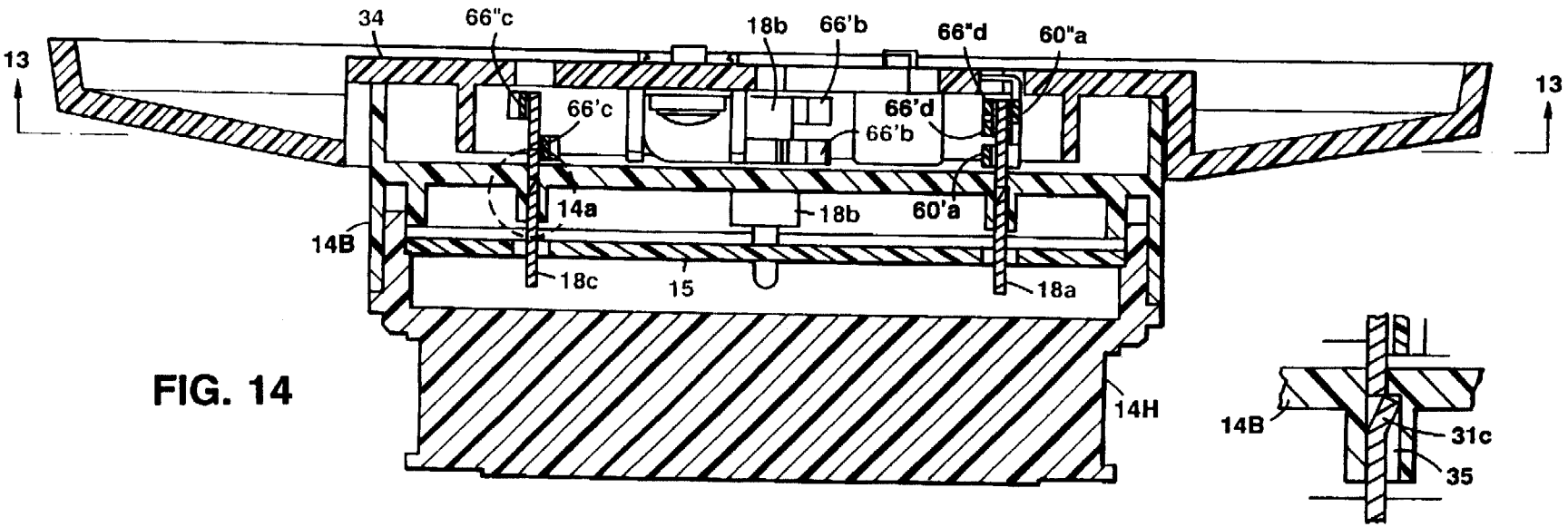
FIG. 14 is a elevation view showing the relationship between electrical contacts of the sensor section of the detector of FIGS. 1 and 2 and the electrical contacts of the base section after such contacts become electrically connected; and, FIG. **14*a* is a elevation view of the portion of FIG. 14 enclosed by a circle labelled 14*a***.

As noted above, the sensor base 14B is attachable to/removable from the base section 12. More particularly, and referring again to FIGS. 1 and 2, the sensor base 14B is formed with three tabs 15*a*, 15*b*, 15*c*, adapted to be inserted into slots 17*a*, 17*b*, 17*c* formed in the mounting plate 34. Further, as noted above in connection with FIGS. 3–6, distal ends 60'*a*, 60"*a* are laterally displaced along surface 58*a*. Thus, a shown in FIG. 13, distal end 60*d* of contact 30*d* and distal end 62'*a* of contact 30*a* are in a vertical, overlaying relationship, while distal end 60"*a* of contact 30*a* and distal end 60*d* of contact 30*d* are disposed in a lateral relationship, as shown. When inserted into slots 17*a*, 17*b*, 17*c*, the base electrical contacts 18*a*, 18*b*, 18*c* become positioned to slide into the space 70*a*, 70*b*, 70*c* between distal ends 66'*a*, 66"*a*, 66'*b*, 66"*b*, 66'*c*, 66"*c*, respectively, as indicated in FIGS. 13 and 14. Once inserted, the sensor base 14B is rotated in the direction indicated by arrow 19 so that the tabs 15*a*, 15*b*, 15*c*, slide into receiving pockets 21, in an inter-locking arrangement, to thereby lock the sensor base 14B to lock the base section 12. Further, when rotated, the contact 18*a*, 18*b*, 18*c* slide into the spaces 70*a*, 70*b*, 70*c*, respectively of contacts 30*a*, 30*b*, 30*c*, respectively. More particularly, when rotated, the leading edge of contacts 18*a*, 18*b*, 18*c* engage the distal ends 66'*a*, 66"*a*, 66'*b*, 66"*b*, 66'*c*, 66"*c*, respectively, urging them further apart by camming action while maintaining physical contact with the opposing surfaces of the contacts 18*a*, 18*b*, 18*c*, respectively, because of the resiliency of the cantilevered finger-like contacts 30*a*, 30*b*, 30*c*, 30*d*. Thus, distal ends 66"*a*, 66'*a* contact upper and lower portions, respectively, as shown in FIG. 8, of opposing surfaces, here right and left sides, respectively, of contact 18*a* and distal ends 66'*d*, 66"*d* of contact 30*d* contact two adjacent portions of the left upper surface of contact 18*a*, as shown. Distal ends 66"*c*, 66'*c* contact opposing surfaces of contact 18*c*, and, likewise distal ends 66"*b*, 66'*b* contact opposing surfaces of contact 18*b*, as shown in FIG. 8. Reversing the rotation process enables the sensor base 14B to be removed from the mounting plate 34.

It should be noted that the attachment of the base and sensor sections 12, 14 are, here preferably performed by robotics (i.e., automation) type assembly equipment. It is noted that, using vertically extending electrical contacts for the sensor section 14 enables such sensor section 14 to be robotically inserted into a sensor section 14 test fixture, not shown. The tested sensor section 14 may be robotically removed from the test fixture, and then, if successfully tested, robotically attached to a corresponding base section 12.

Other embodiments are within the spirit and scope of the appended claims.

What is claimed is:

1. A smoke/fire detector assembly, comprising:

a sensor section having a plurality of electrical contacts;

a base section having a corresponding plurality of electrical contacts, each one thereof being adapted to electrically contact a corresponding one of the sensor section electrical contacts; and, wherein the sensor section electrical contacts and the base section electrical contacts are each a single piece of electrically conductive material, and each one of the base section electrical contacts having a threaded hole adapted to receive an electrical terminal screw.

2. The assembly recited in claim 1 wherein one of the electrical contacts in the sensor section has a longitudinally extending portion and the electrical contact in the base section corresponding thereto has a pair of finger-like members positioned to electrically contact points longitudinally spaced along opposite surfaces of said portion of the corresponding sensor section electrical contact.

3. The assembly recited in claim 2 wherein the base section includes an additional electrical contact adapted to electrically contact, in common, with one of the sensor electrical contacts contacted by the one of the aforementioned base section of electrical contacts, such additional electrical contact being a single piece of electrically conductive material.

4. The assembly recited in claim 3 wherein the additional electrical contact is bifurcated to make contact with two points on the same surface of the sensor section electrical contact, the opposite surface of such sensor section electrical contact being contact in common with the other, aforementioned, one of the base section electrical contacts.

5. A smoke/fire detector assembly, comprising:

a sensor section having a plurality of electrical contacts;

a base section having a corresponding plurality of electrical contacts, each one thereof being adapted to electrically contact a corresponding one of the sensor section electrical contacts; and, wherein one of the electrical contacts extends longitudinally and the electrical contact corresponding thereto has a pair of finger-like members positioned to electrically contact points longitudinally spaced along opposite surfaces of corresponding electrical contact.

6. The assembly recited in claim 5 wherein the base section includes an additional electrical contact adapted to electrically contact, in common, with one of the sensor electrical contacts contacted by the one of the aforementioned base section of electrical contacts, such additional electrical contact being a single piece of electrically conductive material.

7. The assembly recited in claim 6 wherein the additional electrical contact is bifurcated to make contact with two points on the same surface of the sensor section electrical contact, the opposite surface of such sensor section electrical contact being contact in common with the other, aforementioned, one of the base section electrical contacts.

8. A smoke/fire detection assembly, comprising:

a sensor section having a plurality of electrical contacts, each one of the sensor section electrical contacts having: a first end extending longitudinally externally from the sensor section; and a second end extending into the sensor section and electrically connected to an electrical component within the sensor section;

a base section having a corresponding plurality of electrical contacts, each of such base section contacts comprising:

a first section having a surface adapted for mounting to a surface of the base section;

a second section, having a common edge with the first section and a surface extending perpendicular to a surface of the first section; and, a pair of finger-like members, extending from a second edge of the second section, the second edge of the second section being perpendicular to the common edge, the finger-like members being laterally spaced along, and cantilevered from, the second edge, the finger-like members extending along a common direction and perpendicular to the first end of the sensor section electrical contacts, distal ends of the finger-like members being spaced from each other laterally in a direction perpendicular to the common direction to receive, and contact, opposing surfaces of the first end of the sensor electrical contact;

the first section, second section, and pair of finger-like members being a single piece.

9. The assembly recited in claim 8, including an additional base section electrical contact adapted to engage, together with one of plurality of base section electrical contacts, a common one of the sensor section electrical contacts.

10. The assembly recited in claim 9 wherein the plurality of base section electrical contacts are electrically connected to corresponding electrical terminals.

11. The assembly recited in claim 10 wherein the additional base section electrical contact is electrically connected to an additional base section electrical terminal and includes:

a first mounting section, adapted for mounting to a surface of the base section; a second section, having a first edge disposed along an edge of, and extending perpendicular to, the first section; and, a finger-like member extending from a second edge of the section, the second edge of the second section being disposed perpendicular to the first edge of the second section, the finger-like member being cantilevered from, the second edge of the second section.

12. The assembly recited in claim 11 wherein the first section, second section, and finger-like member of the additional base section electrical contact is a single piece.

13. The assembly recited in claim 11 wherein the distal end of the finger-like member of the additional base section electrical contact is bifurcated and is adapted to make contact with two points on the same surface of the sensor section electrical contact, the opposite surface of such sensor section electrical contact being contacted by said one of the pair of finger-like members of the above mentioned one of the plurality of base section electrical contacts.

14. A smoke/fire detector assembly, comprising:

a sensor section having a plurality of electrical contacts having longitudinally extending portions;

a base section having a corresponding plurality of electrical contacts, each one thereof being adapted to electrically contact a corresponding one of said sensor section electrical contact portion; and, wherein the base section electrical contact corresponding thereto has a pair of finger-like members spaced longitudinally along a direction parallel to the longitudinally extending portion of the sensor section electrical contacts and positioned to electrically contact points longitudinally spaced along opposite surfaces of said longitudinally extending portion of the corresponding sensor section electrical contact.

* * * * *